US008559657B2

(12) United States Patent
Akino et al.

(10) Patent No.: US 8,559,657 B2
(45) Date of Patent: Oct. 15, 2013

(54) CAPACITOR MICROPHONE

(75) Inventors: Hiroshi Akino, Tokyo (JP); Satoshi Yoshino, Tokyo (JP); Haruhito Shimura, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 639 days.

(21) Appl. No.: 12/817,830

(22) Filed: Jun. 17, 2010

(65) Prior Publication Data

US 2010/0329483 A1 Dec. 30, 2010

(30) Foreign Application Priority Data

Jun. 26, 2009 (JP) ..... 2009-151768

(51) Int. Cl.
*H04R 3/00* (2006.01)

(52) U.S. Cl.
USPC ..... 381/111; 381/174; 381/355; 381/356

(58) Field of Classification Search
USPC ..... 381/111, 115, 172, 174, 355, 356, 357, 381/358, 360, 369, 173, 190, 191; 29/25.41, 25.42
See application file for complete search history.

(56) References Cited

U.S. PATENT DOCUMENTS

2005/0135641 A1* 6/2005 Akino ..... 381/174
2008/0152174 A1* 6/2008 Marshall ..... 381/172

FOREIGN PATENT DOCUMENTS

JP 02-237300 9/1990
JP 2006-005710 1/2006

* cited by examiner

*Primary Examiner* — Duc Nguyen
*Assistant Examiner* — Phan Le
(74) *Attorney, Agent, or Firm* — Whitham Curtis Christofferson & Cook, PC

(57) ABSTRACT

Diaphragms of a plurality of capacitor microphone units are arranged in the same plane and the capacitor microphone units are connected in series to make an output from an impedance converter connected to one capacitor microphone unit drives a ground side of another capacitor microphone unit connected to the impedance converter.

5 Claims, 2 Drawing Sheets

CAPACITOR MICROPHONE

BACKGROUND OF THE INVENTION

1. Field of the Invention

The present invention relates to a capacitor microphone that has excellent directional frequency response up to a high frequency domain, and excellent sensitivity.

2. Description of the Related Art

Capacitor microphones have a basic configuration such as that disclosed in Japanese Patent Application Publication H2-237300. More specifically, capacitor microphones include: a capacitor microphone unit composed of a diaphragm a fixed pole that are provided facing each other via a spacer; and a sound signal output unit including an impedance converter that converts vibration of the diaphragm due to sound waves into an electrical signal as a change in capacitance.

A unidirectional capacitor microphone includes: a front acoustic terminal with which sound waves from a sound source are directly applied to the front surface side of a diaphragm; and a rear acoustic terminal with which the sound waves are applied to the rear surface side of the diaphragm.

A capacitor microphone unit is classified as small or large according to its bore diameter. Generally, the classification is such that, a capacitor microphone unit having a bore diameter equal to or smaller than 20 millimeters is classified as small, while a capacitor microphone unit having a bore diameter larger than 20 millimeters, e.g., 1 inch (25.4 millimeters), is classified as large.

In a small capacitor microphone unit with bore diameter equal to or smaller than 20 millimeters, the distance between a front acoustic terminal and a rear acoustic terminal can be made small. Thus, a small capacitor microphone has excellent directional frequency response in a high frequency domain. Unfortunately, the diaphragm therein has small area. Thus, a small capacitor microphone has poor sensitivity and S/N ratio.

On the other hand, a large capacitor microphone unit having bore diameter larger than 20 millimeters has a diaphragm of a large area. Thus, a large capacitor microphone has excellent sensitivity and S/N ratio. Unfortunately, the distance between a front acoustic terminal and a rear acoustic terminal is large and therefore, frequency response in high frequency range is poor.

S/N ratio depends on how the impedance converter is designed. Generally, better S/N ratio can be obtained with larger effective capacity.

A capacitor microphone can have higher sensitivity by, for example, increasing the driving forte for a diaphragm, lowering an impedance of a capacitor microphone unit, or increasing the area of a diaphragm (using a large capacitor microphone unit).

With a capacitor microphone unit having a diaphragm of a large area, higher sensitivity can be provided but frequency response in high frequency domain is degraded. A capacitor microphone is known that solves such problems and reduces intrinsic noise without degrading directional frequency response (see, for example, Japanese Patent Application 2006-5710).

In a capacitor microphone disclosed in Japanese Patent Application Publication 2006-5710, capacitor microphone units are connected in parallel. Therefore, sensitivity is difficult to be improved.

SUMMARY OF THE INVENTION

The present invention is made in view of the above. An object of the present invention is to provide a capacitor microphone having advantages of both large and small capacitor microphone units. More specifically, the present invention provides a capacitor microphone that has excellent frequency response in a high frequency domain and excellent S/N ratio.

An embodiment of the present invention is a capacitor microphone including a plurality of capacitor microphone units. Diaphragms of the capacitor microphone units are arranged in the same plane and the capacitor microphone units are connected in series to make an output from an impedance converter connected to one capacitor microphone unit drives a ground side of another capacitor microphone unit connected to the impedance converter.

In the capacitor microphone according to the present invention, preferably, two sets of the capacitor microphone units connected in series are provided and outputs from the two sets of capacitor microphone units are a hot-side and a cold-side output for a balanced output.

According to the present invention, if each of the capacitor microphone units is small, as an acoustic mechanical vibration system, the capacitor microphone units each serve as a small capacitor microphone unit having excellent directional frequency response in a high frequency domain. The capacitor microphone units are electrically connected to respective impedance converters, and the capacitor microphone units are connected in series via the impedance converters. Thus, an output voltage is multiplied by the number of capacitor microphone units connected in series. Thus, S/N ratio becomes to be high and, in accordance with this, the sensitivity becomes to be high. Accordingly, a capacitor microphone can be provided that has excellent directional frequency response up to a high frequency domain, and excellent S/N ratio.

DETAILED DESCRIPTION OF THE PREFERRED EMBODIMENTS

Figure 1:
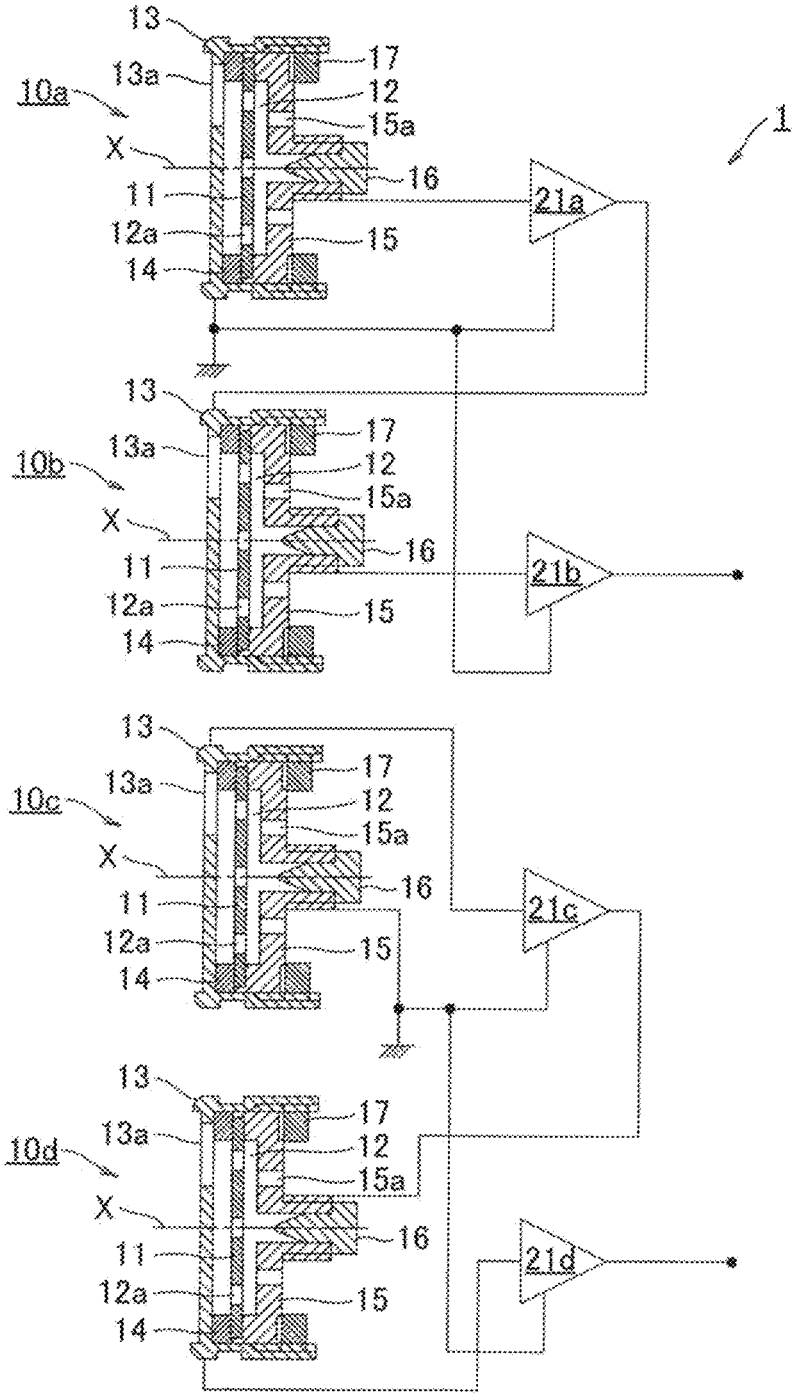
FIG. 1 is schematic cross-sectional view of an embodiment of a capacitor microphone according to the present invention.
Figure 2:
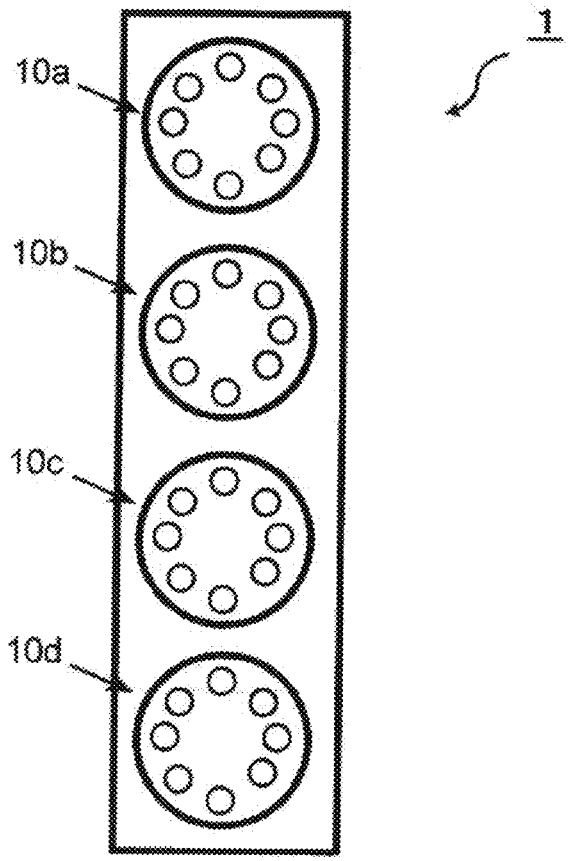
FIG. 2A is a diagram exemplary illustrating an arrangement of capacitor microphone units as viewed from the sound source side.
FIG. 2B is a diagram exemplary illustrating another arrangement of capacitor microphone units as viewed from the sound source side.
Figure 2:
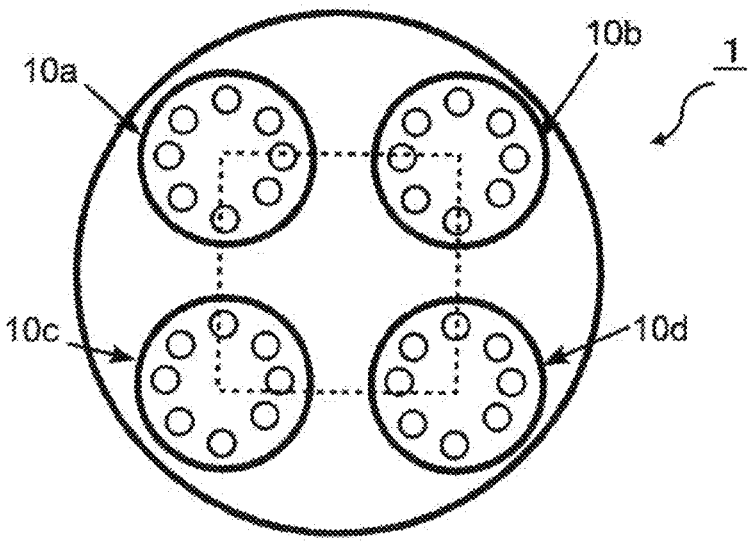

An embodiment of a capacitor microphone according to the present invention is described with reference to the accompanying drawings. FIG. 1 is a schematic cross-sectional view illustrating a structure of a capacitor microphone according to the present invention. FIGS. 2A and 2B each exemplary illustrates an arrangement of capacitor microphone units when viewed from the sound source side.

In FIG. 1, this capacitor microphone 1 is composed of a plurality of capacitor microphone units 10 (10*a* to 10*d*). The capacitor microphone units 10*a* to 10*d* are each a small capacitor microphone unit having excellent directional frequency response in a high frequency domain. The capacitor microphone units 10*a* to 10*d* have an identical structure.

Detail structure is described with reference to the capacitor microphone unit 10*a* in FIG. 1. The capacitor microphone unit 10*a* includes a diaphragm 11, a fixed pole 12, and a casing 13. The diaphragm 11 and the fixed pole 12 are provided facing each other via a spacer ring formed of an insulating material, and are incorporated in the casing 13.

The casing 13 is, for example, a cylindrical body made of conductive metal such as brass or aluminum, and a front acoustic terminal (hole) 13*a* is provided on one end side (left side in FIG. 1) thereof that is directed to a side of a sound source not illustrated upon picking up sound. Although each of the capacitor microphone units 10*a* to 10*d* has a single front acoustic terminal in FIG. 1, actually a plurality of front acoustic terminals is concentrically arranged with equal intervals as exemplary illustrated in FIGS. 2A and 2B.

A capacitor is formed between the diaphragm 11 and the fixed pole 12. The diaphragm 11 is formed of, for example, a thin synthetic resin film on which a metal film is deposited. The diaphragm 11 is incorporated in the casing 13 at the front acoustic terminal 13*a* side while being stretched with certain tensile force applied with a supporting ring 14 made of metal. The diaphragm 11 is electrically connected to the casing 13 via the supporting ring 14.

The fixed pole 12 incorporated in the casing 13 faces the diaphragm 11 via the spacer ring, in a state supported by an insulating base 15 made of synthetic resin. A fixing lock ring 17 is screwed on to the other end, i.e., an opening end, of the casing 13 to fix the fixed pole 12 at a certain position in the casing 13. The fixed pole 12 is insulated from the casing 13 by the insulating base 15.

Sound path holes 12*a* and 15*a* are provided on the fixed pole 12 and the insulating base 15, respectively. Through the sound path holes 12*a* and 15*a*, sound waves from a rear acoustic terminal, not illustrated, are applied on the rear surface side of the diaphragm 11. An extracting electrode 16 for the fixed pole 12 is provided on the insulating base 15. A conductive film, not illustrated, through which the fixed pole 12 and the extracting electrode 16 are electrically connected, is formed at an inner side of the insulating base 15.

In the capacitor microphone 1 according to the present embodiment, as illustrated in FIG. 1, each of the capacitor microphone units 10 has the extracting electrode 16 or the casing 13 at the diaphragm 11 side connected to an input terminal of the respective impedance converters 21. The capacitor microphone units 10*a* and 10*b*, as well as the capacitor microphone units 10*c* and 10*d* are so connected in series that the output from the impedance converters 21 drives the ground side of the capacitor microphone unit 10 of which the extracting electrode 16 or the casing 13 at the diaphragm 11 side is connected to the output terminal of the respective impedance converter 21.

More specifically, in FIG. 11, the extracting electrode 16 of the capacitor microphone unit 10*a* is connected to the input terminal of the impedance converter 21*a*, while the output terminal of the impedance converter 21*a* is connected to the casing 13 at the diaphragm 11 side of the capacitor microphone unit 10*b*. The extracting electrode 16 of the capacitor microphone unit 10*b* is connected to the input terminal of the impedance converter 21*b*. The output terminal of the impedance converter 21*b* serves as a hot-side output terminal for balanced output. The diaphragm 11 side of the casing 13 of the capacitor microphone unit 10*a* is connected to the ground.

Thus, the capacitor microphone units 10*a* and 10*b* are so connected in series that an output from the impedance converter 21*a* connected to the capacitor microphone unit 10*a* drives the ground side (diaphragm 11) of the capacitor microphone unit of which the diaphragm 11 side of the casing 13 is connected to the output terminal of the impedance converter 21*a*, i.e., the capacitor microphone unit 10*b*.

Further, in FIG. 1, the casing 13 at the diaphragm 11 side of the capacitor microphone unit 10*c* is connected to the input terminal of the impedance converter 21*c*, while the output terminal of the impedance converter 21*c* is connected to the extracting electrode 16 of the capacitor microphone unit 10*d*. The casing 13 at the diaphragm 11 side of the capacitor microphone unit 10*d* is connected to the input terminal of the impedance converter 21*d*. The output terminal of the impedance converter 21*d* serves as a cold-side output terminal for balanced output. The extracting electrode 16 of the capacitor microphone unit 10*c* is connected to the ground.

Thus, the capacitor microphone units 10*c* and 10*d* are so connected in series that an output from the impedance converter 21*c* connected to the capacitor microphone unit 10*c* drives the ground side (fixed pole 12) of the capacitor microphone unit of which the extracting electrode 16 is connected to the output terminal of the impedance converter 21*c*, i.e., the capacitor microphone unit 10*d*.

If the impedance converters 21 are formed of a field-effect transistor (FET), the input terminal is the gate electrode, the output terminal is the drain electrode, and the terminal to be grounded is the source electrode.

In the capacitor microphone 1 according to the present embodiment having the above described structure, if each of the capacitor microphone units 10*a* to 10*d* operates as a small capacitor microphone unit (microphone unit having small bore diameter) with excellent directional frequency response at a high frequency domain, as an acoustic mechanical vibration system, because an output from a capacitor microphone unit 10 electrically drives the ground side of the capacitor microphone unit 10 at the subsequent stage so that an output voltage multiplied by the number of capacitor microphone units connected in series can be obtained, the capacitor microphone units serve as a capacitor microphone unit having excellent S/N ratio.

An arrangement of the capacitor microphone units 10*a* to 10*d* in the capacitor microphone 1 having the above described structure is described below. In the present embodiment, the arrangement is important in balancing the characteristics of the capacitor microphone units 10*a* to 10*d*. The capacitor microphone units 10*a* to 10*d* need to be arranged to have substantially the same distance from the sound source.

As illustrated in FIG. 1, the units 10 are provided in parallel to make the main axis X of each of the units 10*a* to 10*d* to be parallel with each other. Each of the main axes X passes through the center of the diaphragm 11 and also serves as a sound pickup axis. The attitudes of the units 10*a* to 10*d* are so aligned that the diaphragms 11 are on the same plane.

The capacitor microphone units in the capacitor microphone according to the present invention may be longitudinally or laterally aligned. Either way, the capacitor microphone units are arranged to have equal distance from a sound source. In the case where a sound source is provided at a relatively far position, the capacitor microphone units 10*a* to 10*d* may be aligned in a line with their diaphragms 11 in the same plane.

The capacitor microphone units may be so arranged that a true circle can be drawn that passes through imaginary center axes of the capacitor microphone units to have the same distance from the sound source. More specifically, the capacitor microphone units 10*a* to 10*d* may be so arranged that the center axis of each of the capacitor microphone units is positioned at a corner of a rectangular tetragon as illustrated in FIG. 2B. In other words, capacitor microphone units 10 may be so arranged that the center axes thereof are each positioned at a corner of a rectangular polygon with the number of corners corresponding to the number of capacitor microphone units. With such an arrangement, the distance from the sound source to the capacitor microphone units become equal, i.e., all capacitor microphone units 10 have equal distance from the sound source.

In the example described above, the capacitor microphone units 10*a* to 10*d* have the same bore diameter. The capacitor microphone according to the present invention can be formed with capacitor microphone units having different bore diameters arranged as described above, as long as the capacitor microphone units are small, i.e., having a bore diameter of equal to or smaller than 20 millimeters.

In the capacitor microphone according to the present embodiment, in each capacitor microphone unit, a sound entering the diaphragm 11 and then converted into an electrical signal are connected in series and then output. Thus, an output voltage multiplied by the number of capacitor microphone units connected in series can be obtained (20logN). Intrinsic noise of each of the capacitor microphone units 10 is non-correlated. Therefore, intrinsic noise is not multiplied by the number of capacitor microphone units connected in series and increases for 10logN.

Thus, S/N ratio can be improved about twice. All things considered, S/N ratio can be improved along with sensitivity.

What is claimed is:

1. A capacitor microphone comprising:

an impedance converter; and a plurality of capacitor microphone units, each of said plurality of capacitor microphone units has a diaphragm, wherein each of said diaphragms is arranged to be in a same plane, wherein each of said plurality of capacitor microphone units is electrically connected in series in order to output a voltage from the impedance converter to one of said plurality of capacitor microphone units, and wherein said output voltage electrically drives a ground side of another of said plurality of capacitor microphone units also connected to the impedance converter.

2. The capacitor microphone according to claim 1, wherein two sets of the plurality of said capacitor microphone units electrically connected in series are provided, and wherein outputs from the two sets of the plurality of said capacitor microphone units are a hot-side output and a cold-side output for a balanced output.

3. A capacitor microphone comprising:

a first capacitor microphone unit has a first extracting electrode connected to a first input terminal of a first impedance converter;

a second capacitor microphone unit has a second extracting electrode connected to a second input terminal of a second impedance converter;

a first diaphragm side of a first casing of the first capacitor microphone unit is connected to the ground; and a first output terminal of the first impedance converter is connected to a second casing at a second diaphragm side of the second capacitor microphone unit.

4. The capacitor microphone according to claim 3 further comprising:

a third capacitor microphone unit has a third casing at a third diaphragm side connected to a third input terminal of a third impedance converter;

a fourth capacitor microphone unit has a fourth casing at a fourth diaphragm side connected to a fourth input terminal of a fourth impedance converter;

a third extracting electrode of the third capacitor microphone unit is connected to the ground; and a second output terminal of the third impedance converter is connected to a fourth extracting electrode of the fourth capacitor microphone unit.

5. The capacitor microphone according to claim 4 further comprising:

a third output terminal of the second impedance converter is a hot-side output terminal for a balanced output; and a fourth output terminal of the fourth impedance converter is a cold-side output terminal for the balanced output.

* * * * *